US006283583B1

(12) United States Patent
Imaizumi et al.

(10) Patent No.: US 6,283,583 B1
(45) Date of Patent: Sep. 4, 2001

(54) IMAGE FORMING APPARATUS HAVING FLOAT ELECTRODE PROVIDED TO MAKE UNIFORM ELECTRIC FIELD

(75) Inventors: Daisaku Imaizumi, Yamatokoriyama; Yukihito Nishio, Ikoma-gun; Hirokazu Fujita, Nara; Shirou Wakahara, Chiba, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/121,882

(22) Filed: Jul. 24, 1998

(30) Foreign Application Priority Data

Jul. 28, 1997 (JP) ..... 9-201180

(51) Int. Cl.[7] ..... B41J 2/06
(52) U.S. Cl. ..... 347/55
(58) Field of Search ..... 347/55, 154, 103, 347/123, 111, 159, 127, 128, 17, 141, 120; 399/271, 290, 292, 293, 294, 295

(56) References Cited

U.S. PATENT DOCUMENTS 5,745,144 * 4/1998 Christy .
5,767,879 * 6/1998 Tsukamoto et al. .
5,850,244 * 12/1998 Leonard et al. .
6,012,801 * 1/2000 Nilsson .

FOREIGN PATENT DOCUMENTS 6-91918 4/1994 (JP) .

* cited by examiner

*Primary Examiner*—John Barlow
*Assistant Examiner*—Raquel Yvette Gordon
(74) *Attorney, Agent, or Firm*—David G. Conlin; William J. Daley, Jr.; Dike, Bronstein, Roberts and Cushman

(57) ABSTRACT

An image forming apparatus capable of forming an image with uniform density includes a toner carrier for carrying a toner, an opposing electrode arranged opposing to the toner carrier, a high voltage power supply unit for supplying a voltage to generate a potential difference between the toner carrier and the opposing electrode, a control electrode including a plurality of electrodes arranged between the toner carrier and the opposing electrode, and a control power supply unit for implementing a plurality of potential states at respective ones of the electrodes of the control electrode, controlling passage of the toner through a passage portion, and for forming an image on a surface of a recording medium conveyed over the opposing electrode. The control electrode includes an insulating substrate, the aforementioned plurality of electrodes having a passage portion through which the toner passes provided in the insulating substrate, and a plurality of float electrodes having an opening provided such that at least part of the plurality of electrodes are directly or electrically exposed to the toner carrier, for making uniform an electric field formed between the toner carrier and the opposing electrode.

18 Claims, 12 Drawing Sheets

IMAGE FORMING APPARATUS HAVING FLOAT ELECTRODE PROVIDED TO MAKE UNIFORM ELECTRIC FIELD

BACKGROUND OF THE INVENTION

1. Field of the Invention

The present invention relates to an image forming apparatus applied to a printing unit of a digital copying machine, a facsimile or the like as well as to a digital printer, a plotter or the like, for forming an image on a recording medium by jetting a developer.

2. Description of the Background Art

An image forming apparatus outputting image signals as a visible image on an recording medium such as a sheet of paper has been known, as disclosed, for example, in Japanese Patent Laying-Open No. 6-91918. In the image forming apparatus, an electric field is exerted on charged particles so that the particles jet out or travel by the electric force, and by changing potentials applied to a control electrode including a plurality of passage holes arranged along the jet travel path, the charged particles are attracted and adhered on the recording medium, whereby the image is directly formed on the recording medium.

Another image forming apparatus has also been proposed in which a control electrode is provided on an insulating substrate surface near an opposing electrode when a distance between a toner carrier and the insulating substrate is short, and a control electrode is provided on an insulating substrate surface closer to the toner carrier when the distance is long, so that the distance between the control electrode and the toner carrier is made as constant as possible.

In the conventional image forming apparatus having the above described structure, means for controlling passage of charged particles through a gate is used. In such an image forming apparatus, whether charged particles (developer) are allowed to jet out or not is controlled by controlling an electric field generated between the gate and a carrier carrying the developer, and by a strong electric field generated by an opposing electrode, the developer is attracted and reaches the surface of the sheet, which is the recording medium.

In the above described image forming apparatuses, an amount of charged developer which travels or jets is controlled by the electric field formed between the gate and the carrier.

Therefore, when the electric field has different strength, the amount of charged developer which jets differs.

In such an image forming apparatus, when a cylindrical sleeve is used as a charged toner carrier and a control electrode having two-dimensional gate arrangement is used, the distance between the sleeve and the control electrode cannot be made constant because of the curvature of the cylinder, and at an end of the sleeve, the distance to the control electrode is larger than at the central portion.

Accordingly, at the end portion, the generated electric field is weaker, and therefore, the amount of developer passing through the gate and the course of travel are not constant. Therefore, the density of the dots formed at the end portion is low, resulting in unsatisfactory contrast, while the dot density is high at the central portion.

In view of the foregoing, such attempts have been made, as increasing a potential applied to the control electrode at an end portion when the developer is passed. However, in that case, the number of power supplies necessary for adjusting the potential for controlling jetting of the developer is increased. In addition, if difference in the potentials exceeds breakdown voltage of an FET (Field Effect Transistor) used for a circuit for switching potentials, an FET having higher breakdown voltage must be provided separately. This unavoidably leads to increased cost of FETs as well as of necessary measure for insulating the circuit from the high voltage. Therefore, the number of parts and the size of the apparatus are unavoidably increased.

An approach to control jetting of the developer without increasing the breakdown voltage of the FET experiences the following problem.

In order not to increase the breakdown voltage of the FET, height of a potential applied to the control electrode must be limited. Therefore, when a high potential is applied as a potential preventing jetting (hereinafter referred to as OFF potential), then a potential necessary for jetting (hereinafter referred to as ON potential) must be set sufficiently low, which prevents satisfactory jetting of the developer, resulting in blurred image with low contrast.

Conversely, when a high potential is applied as the ON potential, the OFF potential must be set sufficiently low and, in that case, prevention of jetting of the developer will be insufficient, causing a fog. Accordingly, satisfactory contrast cannot be obtained, resulting in poor image formation.

Further, in a color image forming apparatus, not only dot formation but also color reproductivity are degraded as desired toner jetting cannot be ensured. As a result, image quality degrades.

In view of the foregoing, an attempt has been made to change the timing of applying potential to the control electrode in such an image forming apparatus as described above. When this approach is taken, it becomes unnecessary to change the potential to the control electrode in the image forming apparatus. On the other hand, it becomes necessary that a mechanism for changing the timing of potential application is provided for every control electrode. This unavoidably leads to increased cost and size of the apparatus, as the number of parts is increased.

In the image forming apparatus described above, it is desirable that an electric field formed between the carrier and the opposing electrode is kept constant. For this purpose, a method has been known in which the insulating substrate is configured to conform to the curvature of the carrier sleeve, so that the distance between the carrier and the opposing electrode is made constant and the electric field therebetween is kept constant.

However, it is difficult to arrange the carrier and the insulating substrate with high precision. If the arrangement is not sufficiently precise, it is possible that the insulating substrate comes into contact with the surface of the toner carrier, destroying a developer layer carried thereon. In that case, in addition to the problems described above, the state of the developer layer could be changed, and therefore desired control of developer jetting is impossible, preventing satisfactory image formation.

Further, in this case also, color reproduction would be insufficient in a color image forming apparatus, resulting in image degradation. Therefore, such arrangement of the insulating substrate in a practical apparatus has been difficult.

In the above described image forming apparatus, in order to make constant the electric field formed between the carrier and the opposing electrode at an end portion and at the central portion, it may be possible to adjust the positional relation between the carrier and the control electrode such that the relation is the same at the end portion and the central portion. For this purpose, the control electrode is arranged at the insulating substrate further from the carrier of the developer passage gate at the central portion, while at the end portion, the control electrode is arranged on the insulating substrate nearer to the carrier of the developer passage gate. This is another attempt to solve the problem of uneven electric field and resulting difference in toner density.

In that case, it is necessary to provide separate control systems for controlling the control electrodes for the central portion and the end portion on the insulating substrate or it is necessary to provide interconnections for the control electrodes on both surfaces of the insulating substrate. This makes the apparatus complicated and increases the number of parts and cost. In addition, if it becomes necessary to provide ICs for controlling the control electrodes on both surfaces as interconnections are provided on both surfaces of the insulating substrate, attachment of the apparatus to an image forming mechanism would be difficult as compared with attachment simply on one surface.

SUMMARY OF THE INVENTION

The present invention was made in order to solve the above described problems and its object is to provide an image forming apparatus capable of forming an image in a uniform density.

Another object of the present invention is to provide an image forming apparatus which has small number of parts and small size and involves low cost.

The image forming apparatus in accordance with an aspect of the present invention includes a toner carrier for carrying a toner, an opposing electrode arranged opposite to the toner carrier, a high voltage power source unit for supplying a voltage to generate potential difference between the toner carrier and the opposing electrode, a control electrode having a plurality of control electrodes arranged between the toner carrier and the opposing electrode, and a control power supply unit for implementing a plurality of potential states at respective ones of the plurality of electrodes of the control electrode, so as to control passage of toner through a passage portion and to form an image on a surface of a recording medium conveyed over the opposing electrode, in which the control electrode includes an insulating substrate having the aforementioned passage portion of the toner, a plurality of electrodes provided on the insulating substrate and having a passage portion common to the insulating substrate, and a plurality of float electrodes arranged between the toner carrier and the opposing electrode having an opening through which at least part of the plurality of electrodes is exposed to the toner carrier.

As the float electrodes are utilized, unevenness of the electric field between the control electrode and the toner carrier can be avoided without using any special circuit, and hence the electric field can be made uniform by a simple structure. In this manner, image formation with uniform density becomes possible, and it becomes possible to reduce the number of parts, the size of the apparatus and the cost.

Preferably, thickness of the plurality of float electrodes is determined in accordance with the distance between the opening and the toner carrier.

By providing float electrodes and adjusting thickness of the float electrodes in accordance with the present invention, electric field strength between the control electrode and the toner carrier can be made constant even when the distance therebetween varies, and hence unevenness of the electric field can be avoided, without changing the structure of the insulating substrate itself.

More preferably, the positions of the plurality of float electrodes are determined so that the electric field formed between the toner carrier and the opposing electrode is made uniform.

By adjusting the positions of the float electrodes, it becomes possible to change relative positional relation between the control electrode and the toner carrier, and to control the electric field between the control electrode and the toner carrier. Thus, unevenness of the electric field can satisfactorily be avoided.

More preferably, the thickness of the insulating substrate is determined so that the electric field generated between the toner carrier and the opposing electrode is made uniform.

By controlling the thickness of the insulating substrate while not changing the thickness of the float electrodes, it is possible to control the electric field between the control electrode and the toner carrier, and unevenness of the electric field can satisfactorily be avoided.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

FIRST EMBODIMENT

The image forming apparatus in accordance with the embodiments of the present invention will be described with reference to the figures.

Figure 1:
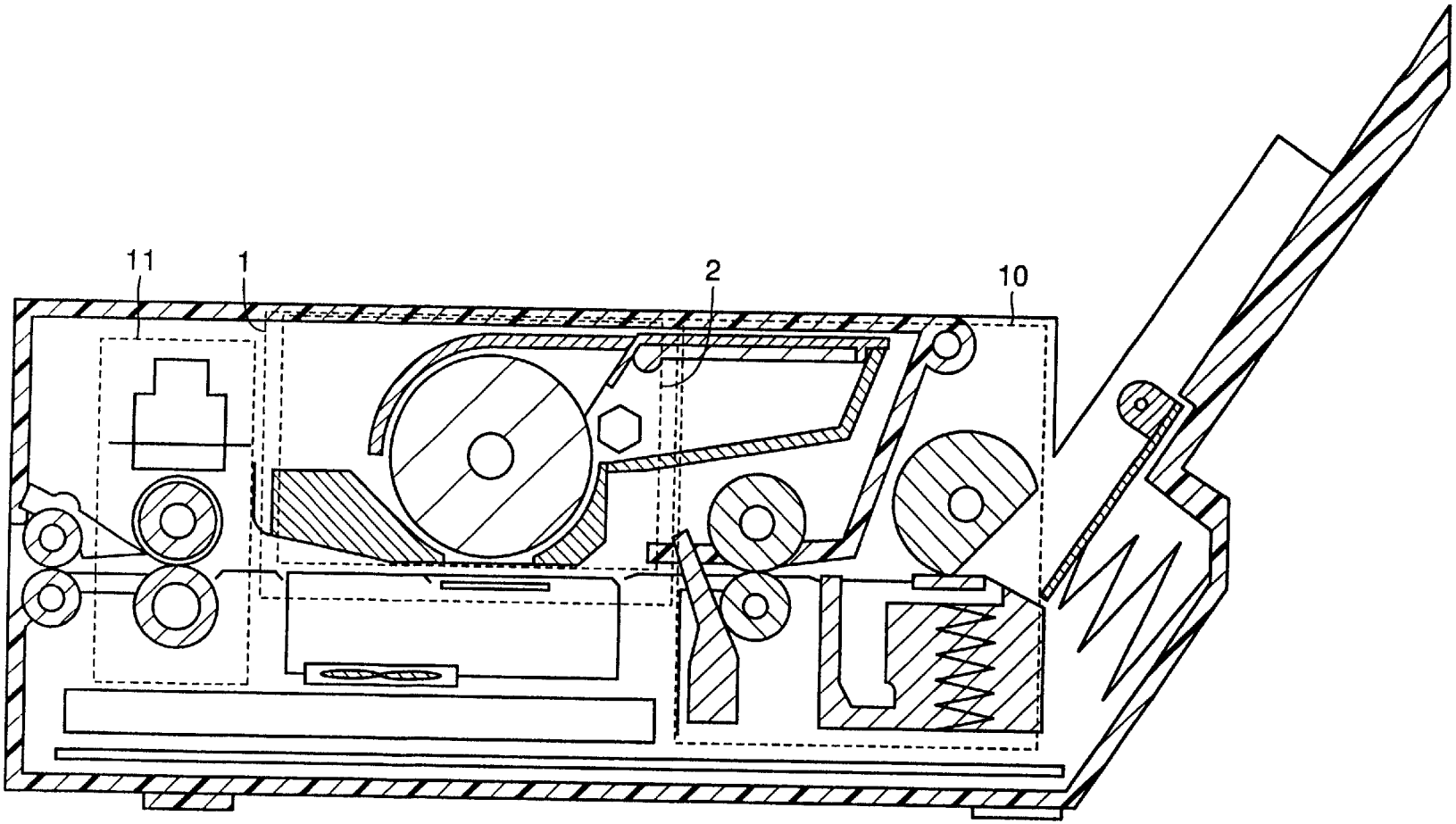
FIG. 1 is a schematic cross section showing a printer, which is an image forming apparatus, having a printing unit in accordance with an embodiment of the present invention.

Referring to FIG. 1, the image forming apparatus includes a paper feeder 10 for feeding sheets of paper, an image forming unit 1 for forming an image on the fed sheet of paper, and a fixing unit 11 for fixing on the sheet the toner image formed on the sheet at the image forming unit 1 by heating and pressurizing.

Figure 2:
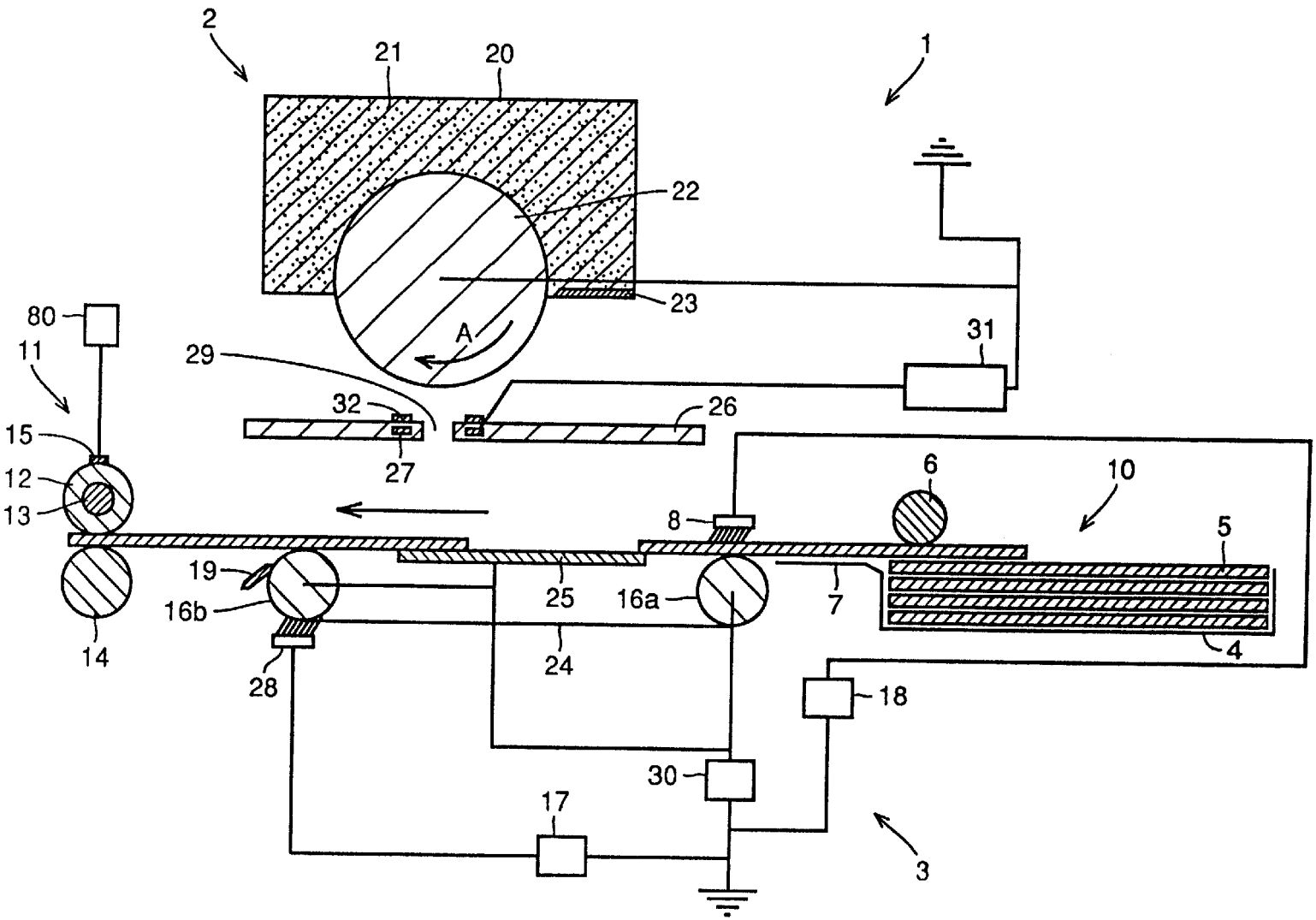
FIG. 2 is a schematic cross section showing a main portion of the printer in accordance with a first embodiment of the present invention.

Referring to FIG. 2, image forming unit 1 includes a toner supply unit 2 and a printing unit 3. The image forming unit 1 is for developing an image corresponding to image signals on a sheet of paper as a recording medium, using a toner as a developer. More specifically, in the image forming apparatus, the toner is jetted and adhered to the sheet, and the jetting of the toner is controlled by the image signals, so that the image is directly formed on the sheet.

At the paper feeding side to the image forming unit 1, paper feeder 10 is provided. Paper feeder 10 includes a sheet cassette 4 containing sheets 5 of paper as recording medium, a pickup roller 6 for picking up and feeding a sheet 5 from sheet cassette 4, and a paper feed guide 7 guiding the supplied sheet 5.

The paper feeder 10 further includes a paper feed sensor (not shown) detecting feeding of sheet 5. Pickup roller 6 is driven to rotate by a driving apparatus, not shown.

Fixing unit 11 includes a heating roller 12, a pressurizing roller 14 arranged to pinch sheet 5 together with heating roller 12, a heater 13 provided in heating roller 12, a temperature sensor 15 arranged to be in contact with the surface of heating roller 12, and a temperature control circuit 80 connected to temperature sensor 15.

Heating roller 12 is formed of an aluminum tube having a thickness of 2 mm, for example. Heater 13 is a halogen lamp, for example, and contained in heating roller 12. Pressurizing roller 14 is formed, for example, of silicone resin. A load 2 kg, for example, is applied by means of a spring or the like to opposing ends of respective shafts of heating roller 12 and pressurizing roller 14 so as to enable pinching and pressurizing of sheet 5.

Temperature sensor 15 measures surface temperature of heating roller 12. Temperature control circuit 80 is controlled by a main controlling unit (not shown), and it controls turning ON/OFF of heater 13 based on the result of measurement by temperature sensor 15, so that the surface temperature of heating roller 12 is maintained at 150° C., for example.

Fixing unit 11 includes a paper discharge sensor (not shown) for detecting discharge of sheet 5.

As described above, fixing unit 11 may have a structure for fixing the toner image by heating or pressurizing sheet 5.

Though not shown, on the sheet discharging side of fixing unit 11, there are a paper discharge roller for discharging sheet 5 received by fixing unit 11 onto a paper discharge tray, and the paper discharge tray receiving the discharge sheet 5.

Heating roller 12, pressurizing roller 14 and the discharge roller are driven to rotate by a driving apparatus, not shown.

Toner supplying unit 2 of image forming unit 1 includes a toner tank 20 containing a toner 21, a toner carrier 22 which is a cylindrical carrier (sleeve) carrying toner 21 by magnetic force, and a doctor blade 23 provided in toner tank 20 for charging toner 21 and regulating thickness of a toner layer carried on an outer peripheral surface of toner carrier 22.

Doctor blade 23 is provided on an upstream side in the direction of rotation of toner carrier 22 such that a distance from the outer peripheral surface of toner carrier 22 is 60 $\mu$m, for example. Toner 21 is a magnetic toner having average grain diameter of 6 $\mu$m, for example, and is charged with negative charges by doctor blade 23 so as to attain the charge amount of −4 $\mu$C/g to −5 $\mu$C/g.

Toner carrier 22 is driven by a driving apparatus, not shown, and rotates, in the direction of an arrow A in the figure. Toner carrier 22 is grounded, and inside toner carrier 22, there are magnets, not shown, fixed at a position opposing to doctor blade 23 and at a position opposing to a control electrode 26, which will be described later, respectively. Each of the magnets has at least two polarities.

Accordingly, toner carrier 22 is able to carry toner 21 on its outer peripheral surface. The toner 21 carried on the outer peripheral surface of toner carrier 22 provides magnetic brush at positions on the outer peripheral surface corresponding to the aforementioned positions.

Toner carrier 22 may carry toner 21 not by magnetic force but by electric force or by electric and magnetic forces.

A printing unit 3 of image forming unit 1 includes an opposing electrode 25 formed of an aluminum plate having the thickness of 1 mm, for example, and opposing to an outer peripheral surface of toner carrier 22, a high voltage power source 30 supplying a high voltage to the opposing electrode 25, a control electrode 26 provided between the toner carrier 22 and the opposing electrode 25, a discharging brush 28, a discharging power source 17 for applying a discharging potential to the discharging brush 28, a charging brush 8 for charging sheet 5, a charging power source 18 for applying the charging potential to the charging brush 8, a dielectric belt 24, support members 16*a* and 16*b* supporting the dielectric belt 24, and a cleaning blade 19.

The opposing electrode 25 is provided such that the distance from the outer peripheral surface of toner carrier 22 is 1.1 mm, for example. Dielectric belt 24 is formed using PVDF (polyvinylidene fluoride) as a base material, and it has a volume resistivity of $10^{10}\Omega\cdot$cm and the thickness of 75 $\mu$m. Dielectric belt 24 is driven by a driving apparatus, not shown, and rotates at a speed of 30 mm/sec at its surface in the direction of the arrow shown in the figure. A high voltage of 2.3 kV, for example, is applied to opposing electrode 25 from high voltage power supply unit 30. More specifically, between opposing electrode 25 and toner carrier 22, an electric field necessary to cause toner 21 carried on toner carrier 22 to travel or jet toward the opposing electrode 25 is generated by the high voltage applied from the high voltage power source unit 30.

Discharging brush 28 is provided to be in pressure contact with dielectric belt 24 at a downstream side of control electrode 26 in the direction of rotation of dielectric belt 24. A discharging potential of 2.5 kV is applied to discharging brush 28 by discharging power source 17, and the brush removes unnecessary charges existing on the surface of dielectric belt 24.

Cleaning blade 19 removes toner 21 when toner 21 adheres on the surface of dielectric belt 24 accidentally, for example, in case of paper jamming, so as to prevent contamination of the rear surface of the sheet by the toner 21.

Though not shown, the image forming apparatus includes, as control circuitry, a main control unit for controlling the overall image forming apparatus, an image processing unit for converting obtained image data to the format of image data to be printed, an image memory for storing converted image data, and an image formation control unit for converting the image data obtained from the image processing unit to image data to be applied to control electrode 26.

The control electrode 26 is parallel to opposing electrode 25 and extends two dimensionally opposing to opposing electrode 25. Control electrode 26 has such a structure that allows passage of the toner 21 from toner carrier 22 to the direction of opposing electrode 25. By a potential applied to control electrode 26, the electric field near the surface of toner carrier 22 changes, whereby jetting of toner 21 from toner carrier 22 to opposing electrode 25 is controlled.

Figure 3:
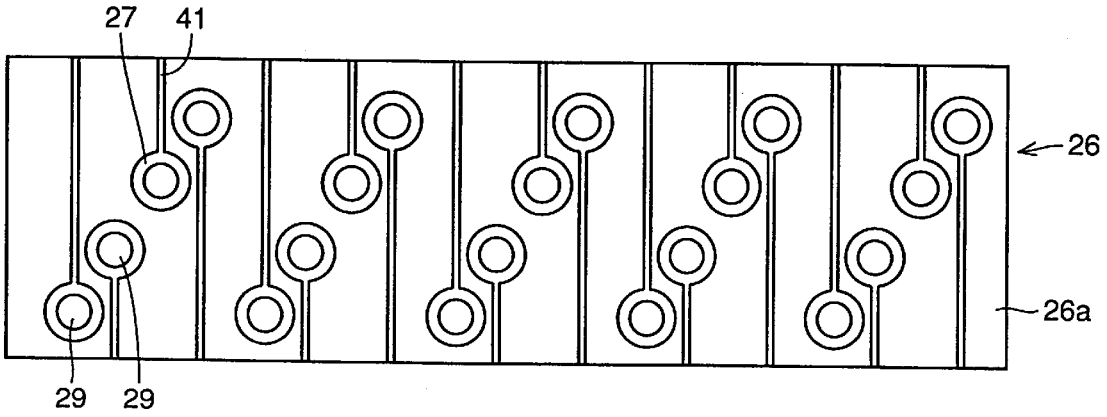
FIG. 3 is a plan view showing the control electrode of FIG. 2.

Control electrode 26 is provided at a distance of 100 μm from the outer peripheral surface of toner carrier 22, for example, and fixed by a support member, not shown. Referring to FIG. 3, control electrode 26 includes an insulating substrate 26*a*, a high voltage driver (not shown) and mutually independent ring-shaped conductors, that is, ring-shaped electrodes 27. Insulating substrate 26*a* is formed of polymide resin, for example, to have a thickness of 25 μm.

Insulating substrate 26*a* is provided with holes which will be gate 29, described later.

Ring-shaped electrodes 27 are each formed of a copper foil having the thickness of 18 μm, around its hole, and provided in accordance with a prescribed arrangement. Opening of each hole is formed to have a diameter of 160 μm, for example, and serves as a passage portion of toner 21 jetting from toner carrier 22 to opposing electrode 25. This passage portion will be referred to as gate 29 in the following.

Each ring-shaped electrode 27 has an opening having opening diameter of 200 μm.

There are 2560 gates 96, that is, the holes formed in the ring-shaped electrodes 27, and the ring-shaped electrodes 27 are electrically connected to control power supply unit 31 through power supply lines 41 and a high voltage driver (not shown).

Further, the surface of ring-shaped electrodes 27 and the surface of power supply lines 41 are covered by a protective layer 26*c* (which will be described with reference to FIG. 6), which is an insulator having the thickness of 30 μm. This ensures insulation of ring-shaped electrodes 27 from each other, insulation of power supply lines 41 from each other, insulation between ring-shaped electrodes 27 and power supply line 41 not connected to each other and insulation between control electrode 26 and toner carrier 22 or opposing electrode 25.

To each ring-shaped electrode 27 of control electrode 26, a pulse in accordance with the image signal, that is, a voltage, is applied by control power supply unit 31. More specifically, control power supply unit 31 applies to ring-shaped electrode 27 a voltage of 150 V (hereinafter referred to as ON potential), for example, when toner 21 carried on toner carrier 22 is to be passed to opposing electrode 25, and applies a voltage of −200 V (hereinafter, OFF potential), for example, if the toner is not to be passed.

When sheet 5 is arranged on that side of opposing electrode 25 which faces toner carrier 22 and a potential applied to control electrode 26 is controlled in accordance with image signal as described above, a toner image in accordance with the image signal is formed on the surface of sheet 5.

Figure 5:
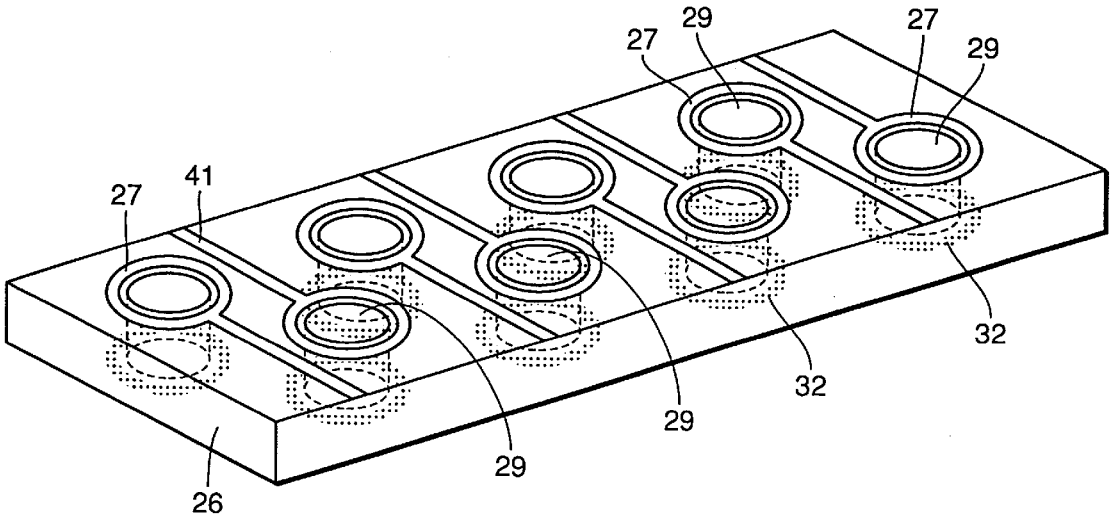
FIG. 5 is a perspective view showing float electrodes of the printer in accordance with the first embodiment of the present invention.

Control power source unit 31 is controlled by a control electrode control signal applied from the image formation control unit, not shown. On that surface of control electrode 26 which faces toner carrier 22, float electrodes 32 are arranged as shown in FIG. 5. Float electrodes 32 will be described later.

Figure 4:
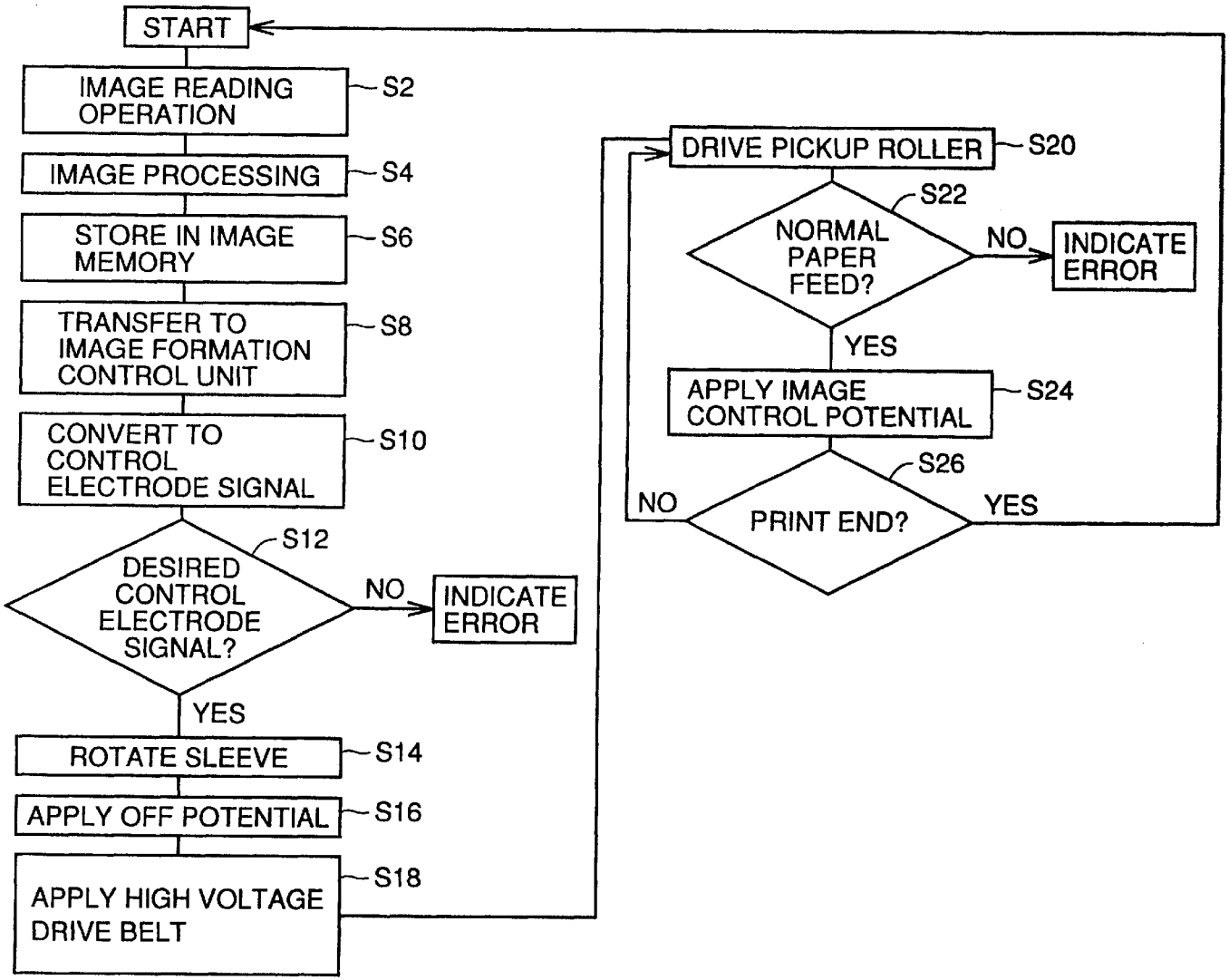
FIG. 4 is a flow chart showing an operation of the printer in accordance with the first embodiment of the present invention.

The image forming apparatus may be used as a printer as an output apparatus for a computer or a word processor, and in addition, it may be used at a printing unit of a digital copying machine. In the following, an operation of image formation when the apparatus is used as a printing unit of the digital copying machine will be described with reference to FIG. 4.

First, an original to be copied is placed at an image reading unit, for example, and when a copy start button (not shown) is operated, the main control unit, receiving the input, starts the image forming operation. More specifically, the original image is read by the image reading unit (S2). The image data is processed by the image processing unit (S4) and stored in the image memory (S6). The image data stored in the image memory is transferred to the image formation control unit (S8). The image formation control unit starts converting the input image data to control electrode control signal to be applied to control electrode 26 (S10).

When a prescribed amount of the control electrode control signals are obtained in the image formation control unit (YES in S12), toner carrier 22 rotates (S14), and OFF potential is applied to toner 21(S16). Thereafter, a high voltage is applied to opposing electrode 25 and dielectric belt 24 is driven (S18). The driving apparatus, not shown, operates, and by pickup roller 6 shown in FIG. 2 which is driven to rotate by the driving apparatus feeds sheet 5 in sheet cassette 4 to image forming unit 1 (S20). At this time, the paper feed sensor detects that the paper feeding is in a normal state (YES in S22). The sheet 5 fed by pickup roller 6 is conveyed to a position between charging brush 8 and support member 16.

A potential same as that applied to opposing electrode 25 is applied to support member 16*a* from high voltage power supply unit 30. A charging potential of 1.2 kV is applied to charging brush 8 by charging power source 18. Charges generated by the potential difference of support member 16*a* to charging brush 8, and sheet 5 is conveyed attracted electrostatically to a surface of dielectric belt 24 opposing to control electrode 26, at printing unit 3 of image forming unit 1.

The prescribed amount of control electrode control signals may differ dependent on the structure of the image forming apparatus.

Thereafter, the image formation control unit supplies the control electrode control signal to control power supply unit 31 (S24). The control electrode control signal is supplied at a timing in synchronization with the supply of sheet 5 to printing unit 3 by the charging brush 8. Based on the control electrode control signal, control power supply unit 31 controls the voltage to be applied to each of the ring-shaped electrodes 27 of control electrode 26.

Specifically, a potential of 150 V or −200 V is applied to prescribed ones of the ring-shaped electrodes 27 from control power supply unit 31, and the electric field near the control electrode 26 is controlled.

More specifically, at gate 29 of control electrode 26, jetting of toner 21 from toner carrier 22 to opposing electrode 25 is prevented/allowed appropriately, in accordance with the image data. In this manner, a toner image in accordance with the image signals is formed on sheet 5 which is moving at the speed of 30 mm/sec to the paper discharge side, as dielectric belt 24 moves over the surface of opposing electrode 25.

Sheet 5 on which the toner image has been formed is separated from dielectric belt 24 because of the curvature of support member 166, and is fed to fixing unit 11, and at the fixing unit 11, the toner image is fixed on the sheet 5. The sheet 5 on which the toner image has been fixed is discharged to the discharge tray by the discharge roller, and the paper discharge sensor detects normal discharge. Based on this detection, the main control unit determines that the printing operation is terminated successfully (YES in S26).

By the above described image forming operation, a good image is formed on the sheet 5. In the image forming apparatus of the present invention, the image is directly formed on sheet 5. Therefore, a photoreceptor or a developer body such as a dielectric drum, which has been used in the conventional image forming apparatus, is unnecessary.

Accordingly, a transfer operation for transferring the image from the developing body to sheet 5 is eliminated, and hence degradation of image quality caused in this operation is prevented.

Thus, reliability of the apparatus is improved. Further, the structure of the device is simplified, and the number of parts is reduced, enabling reduction in size and cost.

No matter whether the image forming apparatus in accordance with the present embodiment is used as a printing unit of an output terminal of a computer or as a printing unit of a digital copying machine, the method of image formation itself is the same, though image signals to be processed and exchanged may be different.

As described above, toner carrier 22 is grounded, a high voltage of 2.3 kV is applied to opposing electrode 25 and support member 16*a*, and a high voltage of 1.2 kV is applied to charging brush 8 by charging power source 18. Because of potential difference between charging brush 8 and support member 16*a*, negative charges are supplied to the surface of sheet 5 conveyed between charging brush 8 and dielectric belt 24.

By the thus supplied negative charges, sheet 5 is kept attracted on dielectric belt 24, and is moved immediately below gate 29 as dielectric belt 24 moves, because of electrostatic force. Charges on the surface of dielectric belt 24 attenuate with time until the belt reaches immediately below gate 29, and because of the influence of the potential of opposing electrode 25, the surface potential attains to about 2 kV.

In this state, in order to pass toner 21 carried by toner carrier 22 toward the direction of opposing electrode 25, a voltage of 150 V is applied from control power supply unit 31 to ring-shaped electrodes 27 of control electrode 26. If toner 21 should not pass through gate 29, a potential of −200 V is applied.

In this manner, an image is directly formed on the surface of sheet 5, with the sheet 5 attracted on dielectric belt 24.

In the foregoing, a potential of 150 V is applied to the ring shaped electrodes 27 of control electrode 26 to allow passage of toner 21, as an example. The potential is not specifically limited, provided that desired jet control of toner 21 is possible. Similarly, the potential to be applied to opposing electrode 25 and to charging brush 8 as well as the potential on the surface of sheet 5 immediately below gate 29 are not specifically limited, provided that desired jet control of toner 21 is possible.

Figure 6:
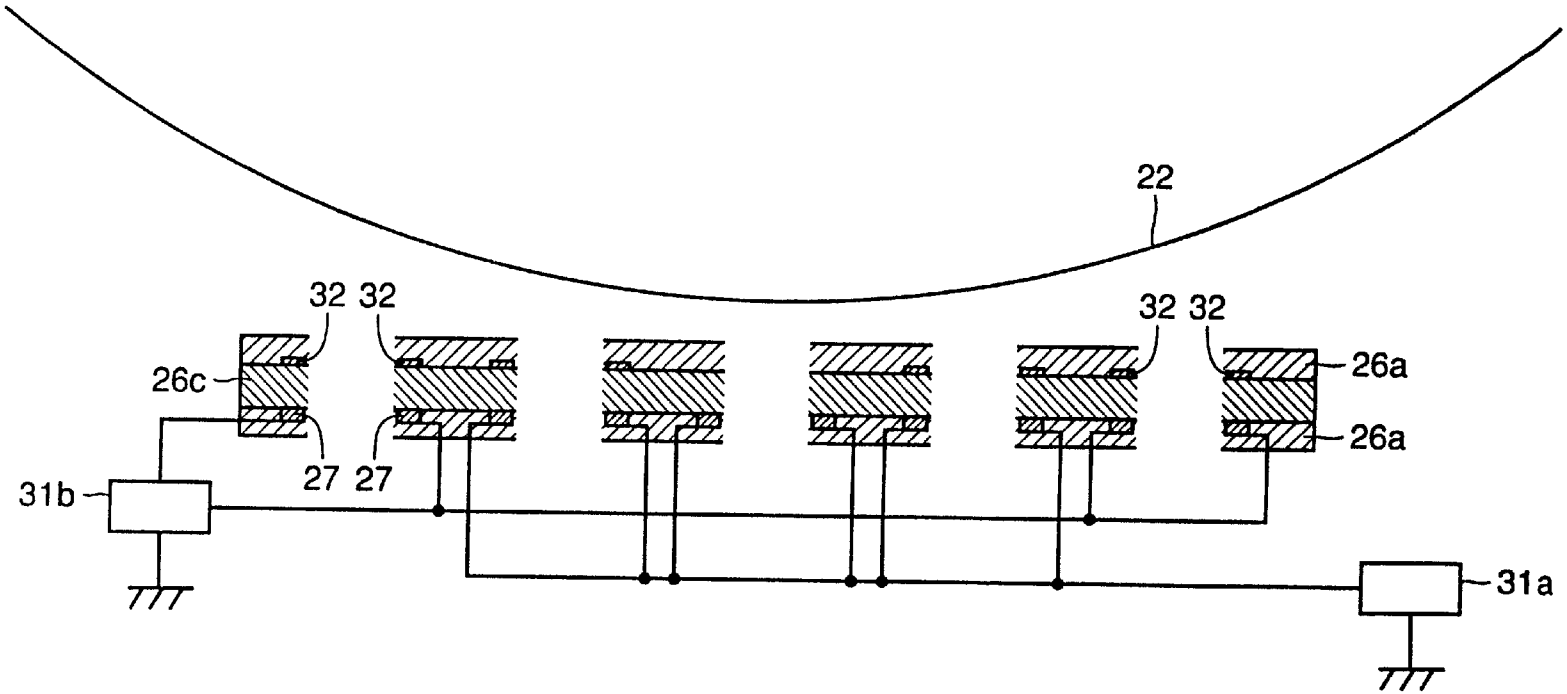
FIG. 6 is a cross section of the float electrodes of the printer in accordance with the first embodiment of the present invention.

Referring to FIG. 6, cross section of float electrode 32 differ dependent on the distance between control electrode 26 and toner carrier 22. Though the opening of each electrode described above is circular, it is not limited thereto, and the opening may be elliptical. For example, the shape of ring-shaped electrode 27 may be circular, and the opening of float electrode 32 may be elliptical or rectangular. Here, it is assumed that to a ring-shaped electrode 27 connected to control electrode 31*a*, a voltage lower than that applied to the ring-shaped electrode connected to control electrode 31*b* is applied.

Float electrode 32 is formed, for example, of an etched copper foil. The method of manufacturing and material of float electrode 32 are not specifically limited.

The shape of the ring-shaped electrodes of the float electrodes 32 making uniform the electric field between control electrode 26 and toner carrier 22 is not specifically limited as long as it is within the spirit and scope of the present invention.

Principle of Operation

Figure 7B:
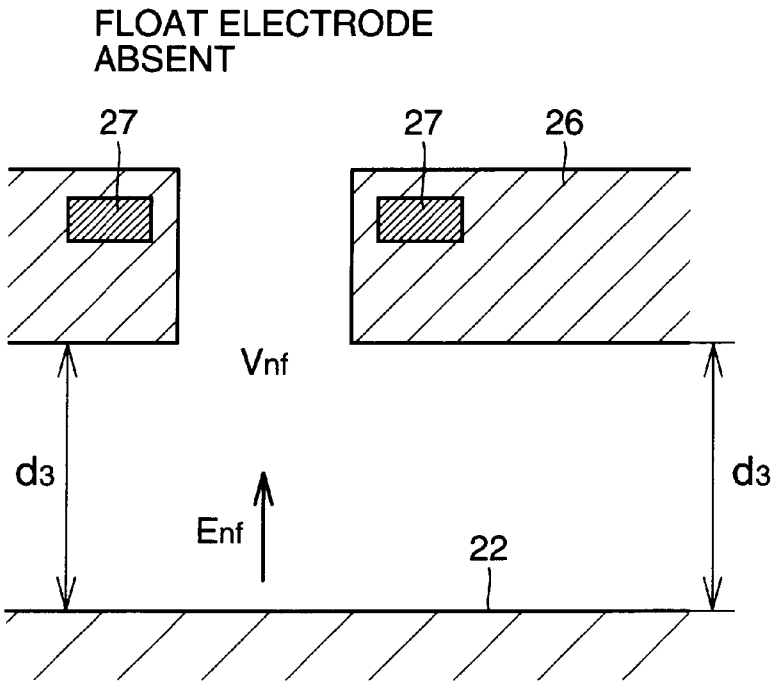
FIG. 7B is the enlarged cross section view of FIG. 7A but without float electrodes.
Figure 7A:
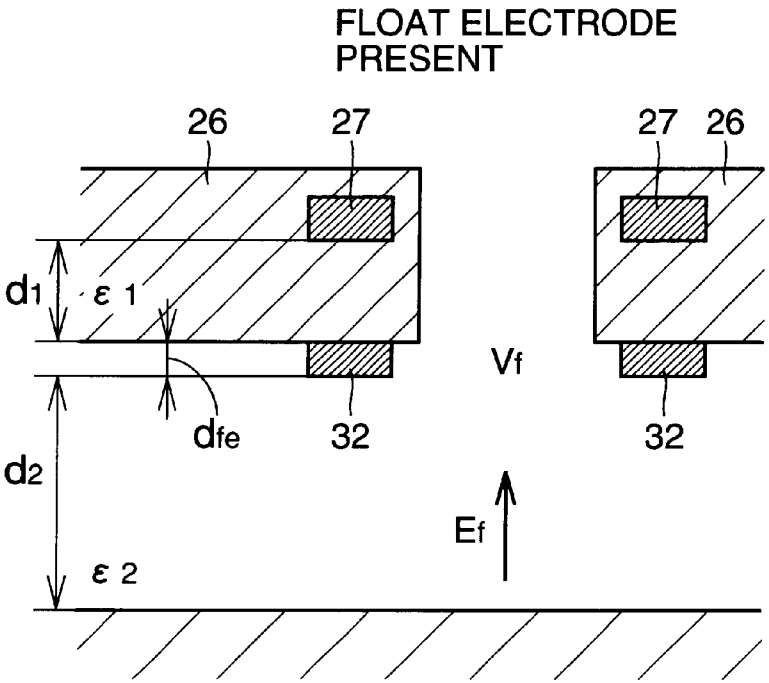
FIG. 7A is an enlarged cross section showing the float electrodes of the printer in accordance with the first embodiment of the present invention.
Figure 8A:
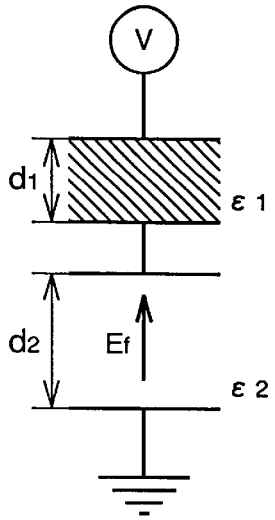
FIGS. 8A and 8B are equivalent circuit diagrams representing principle of operation of the float electrode in the printer in accordance with the first embodiment of the present invention.
Figure 8B:
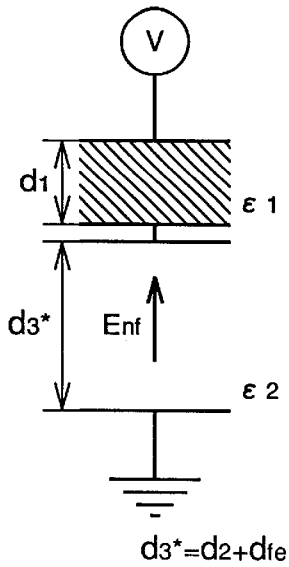

Referring to FIGS. 7A, B distances $d_2$ and $d_3$ between toner carrier 22 and control electrode 26 when control electrode 26 is provided with float electrodes 32 (FIG. 7A) and not provided with the float electrodes (FIG. 7B), respectively, are compared to each other. The distance is shorter when the float electrodes 32 are provided, by the thickness of float electrode 32. FIGS. 8A and 8B are equivalent circuits corresponding to control electrode 26 having and not having the float electrodes 32, respectively.

Let us assume that dielectric constant, capacitor capacitance and potential difference of corresponding portions shown in FIG. 7A, B are as shown in FIGS. 8A and 8B. Further, assume that the same voltage V is applied to the control electrode with or without the float electrode 32. At that time, capacitors come to have such potential differences as represented by the equations (1) and (2) below.

$$Vf = \frac{\varepsilon_1 d_2}{\varepsilon_1 d_2 + \varepsilon_2 d_1} \cdot V \tag{1}$$

$$Vnf = \frac{\varepsilon_1 d_3}{\varepsilon_1 d_3 + \varepsilon_2 d_1} \cdot V \tag{2}$$

$\varepsilon_1$ : dielectric constant of control electrode 26

$\varepsilon_2$ : dielectric contant of air

Based on the potential differences, the electric strengths Ef and Enf of float electrode 32 and toner carrier 22 when there is the float electrode 32 and of the insulating substrate and toner carrier 22 when there is not the float electrode 32 are represented by the following equations (3) and (4), respectively.

$$Ef = \frac{\varepsilon_1}{\varepsilon_1 d_2 + \varepsilon_2 d_1} \cdot V \tag{3}$$

$$Enf = \frac{\varepsilon_1}{\varepsilon_1 (d_2 + d_{fe}) + \varepsilon_2 d_1} \cdot V \tag{4}$$

From the foregoing, the reason why the amount of jetting of the developer increases when float electrode 32 is provided than when not can be explained.

SECOND EMBODIMENT

Figure 9:
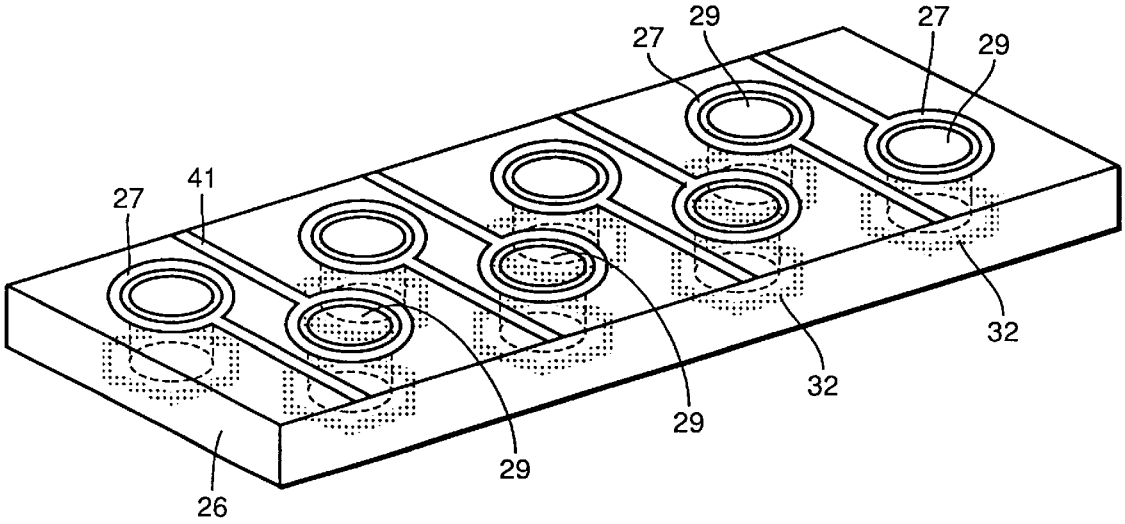
FIG. 9 is a perspective view showing float electrodes in accordance with a second embodiment of the present invention.

Float electrode 32 in accordance with the second embodiment will be described. FIG. 9 shows float electrodes 32 each having a polygonal shape. By changing the shape, it is possible to change the electric field strength between float electrode 32 and toner carrier 22. More specifically, by changing the shape of the control electrode, the area from which the electric field is generated is changed, and accordingly, the strength of the electric field is changed. By using the control electrode in place of the circular control electrode shown in FIG. 5, more appropriate electric field control is possible.

In FIG. 9, a method is shown in which the shape of the electrode surface is changed. The change is not limited, however, to two-dimensional shape of the electrode structure. For example, the electrode shape may be changed three-dimensionally. The method of changing the structure is not specifically limited.

THIRD EMBODIMENT

Figure 10:
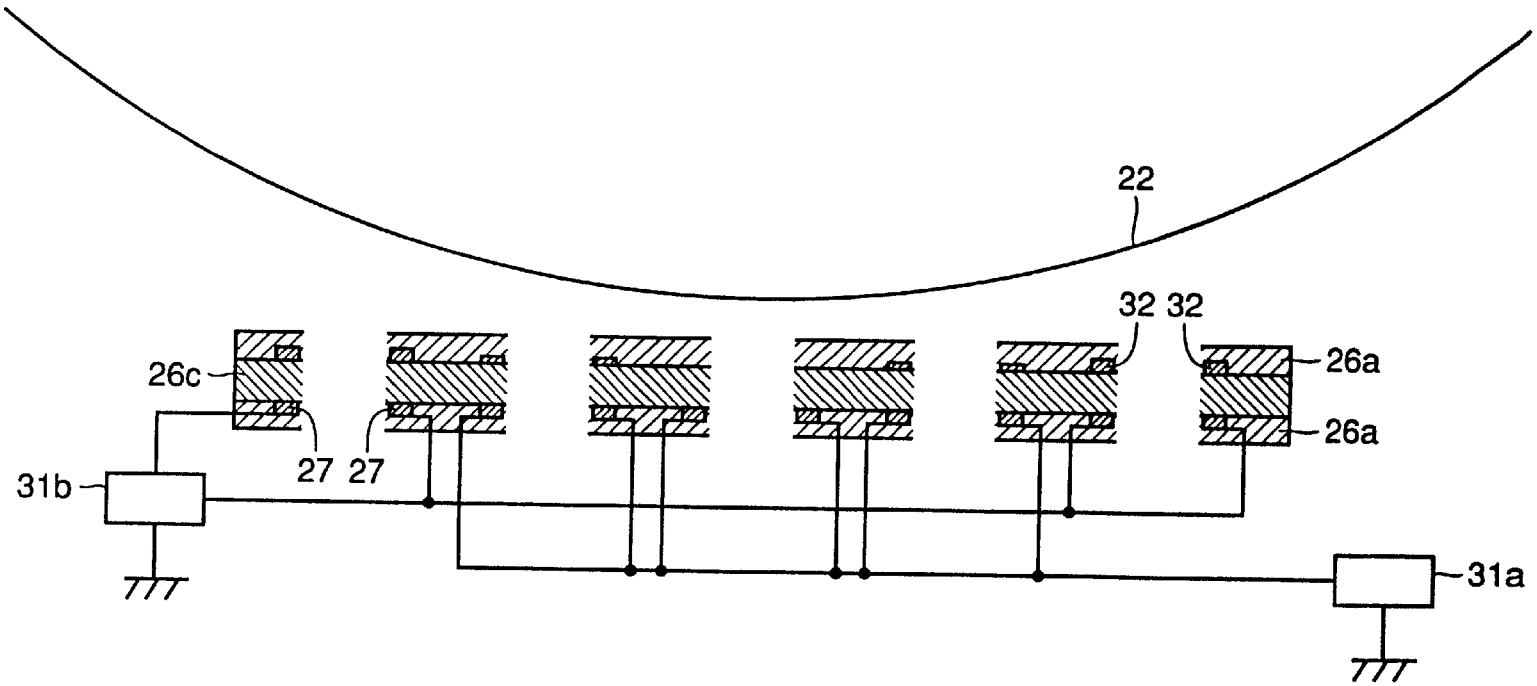
FIG. 10 is a cross section showing an example in which thicknesses of float electrodes are made different, in accordance with a third embodiment of the present invention.

FIG. 10 shows a third embodiment in which float electrodes 32 have different thicknesses. As already described with respect to the principal of operation, the electric field strength changes in proportion to the change in distance between the surface of the float electrode 32 and the toner carrier 22. Therefore, if the electric field strength between the surface of float electrode 32 and toner carrier 22 is to be increased, it is possible by making thicker the float electrode 32. When toner carrier 22 has a curvature as shown in FIG. 10, the distance between the surface of float electrode 32 and toner carrier 22 differs at an end portion and at the central portion. Therefore, the difference in distance can be adjusted by changing the thickness of float electrodes 32. When the distance between centers of the gates at the end portion and at the central portion is 2 mm and the diameter of toner carrier 22 is 30 mm, the developed image comes to have approximately the same density at the central portion and at the end portion when float electrodes 32 having the thickness of 150 $\mu$m are provided, and satisfactory result is obtained. The thickness of the float electrode is not limited to the aforementioned value.

FOURTH EMBODIMENT

Figure 11:
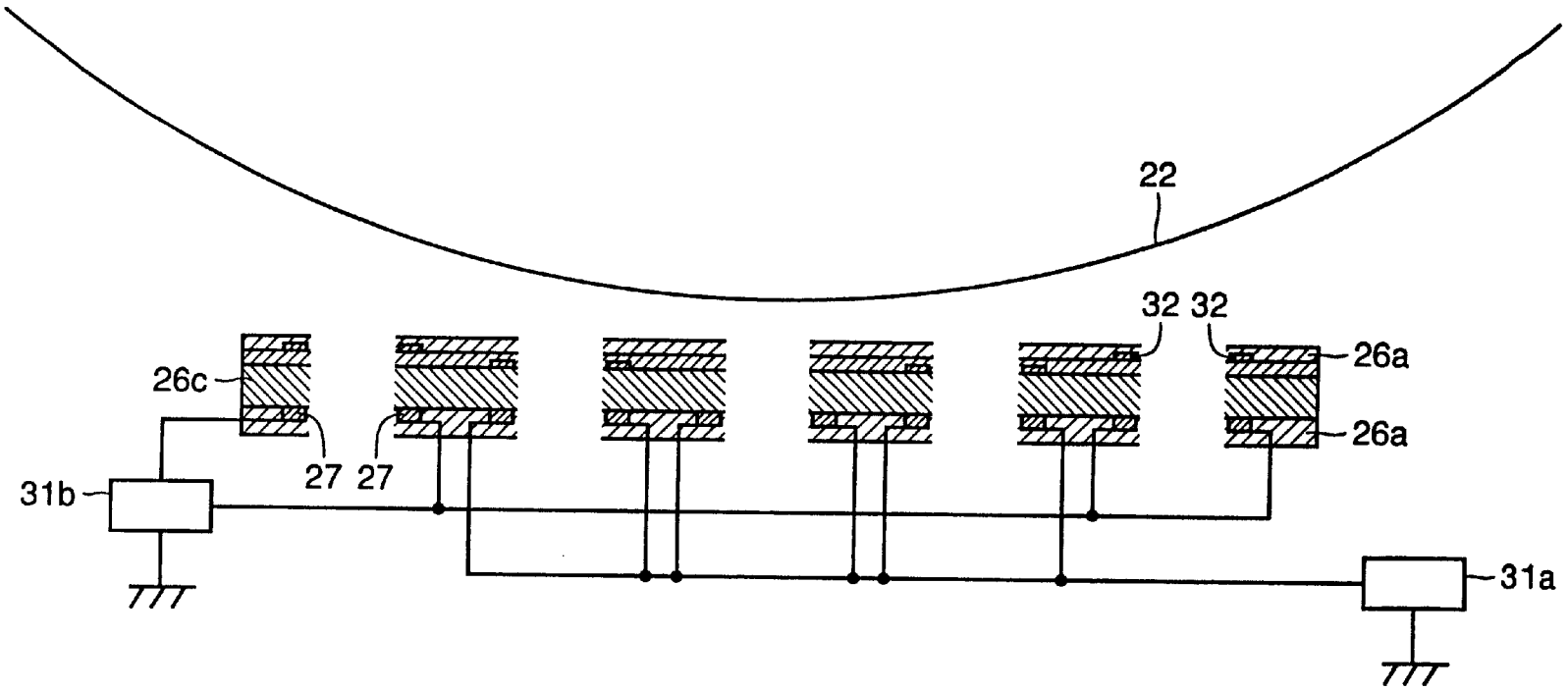
FIG. 11 is a cross section showing float electrodes in accordance with a fourth embodiment of the present invention.

FIG. 11 shows a fourth embodiment of the float electrodes 32. In the method in which thickness of float electrodes 32 is made different described above, it may be difficult to control the thickness dependent on the manufacturing method of the electrode. In such a case, the insulating substrate may be formed in several layers, and by arranging float electrodes 32 having the same thickness at different layers of insulating substrate, similar effect as described above can be obtained.

FIFTH EMBODIMENT

Figure 12:
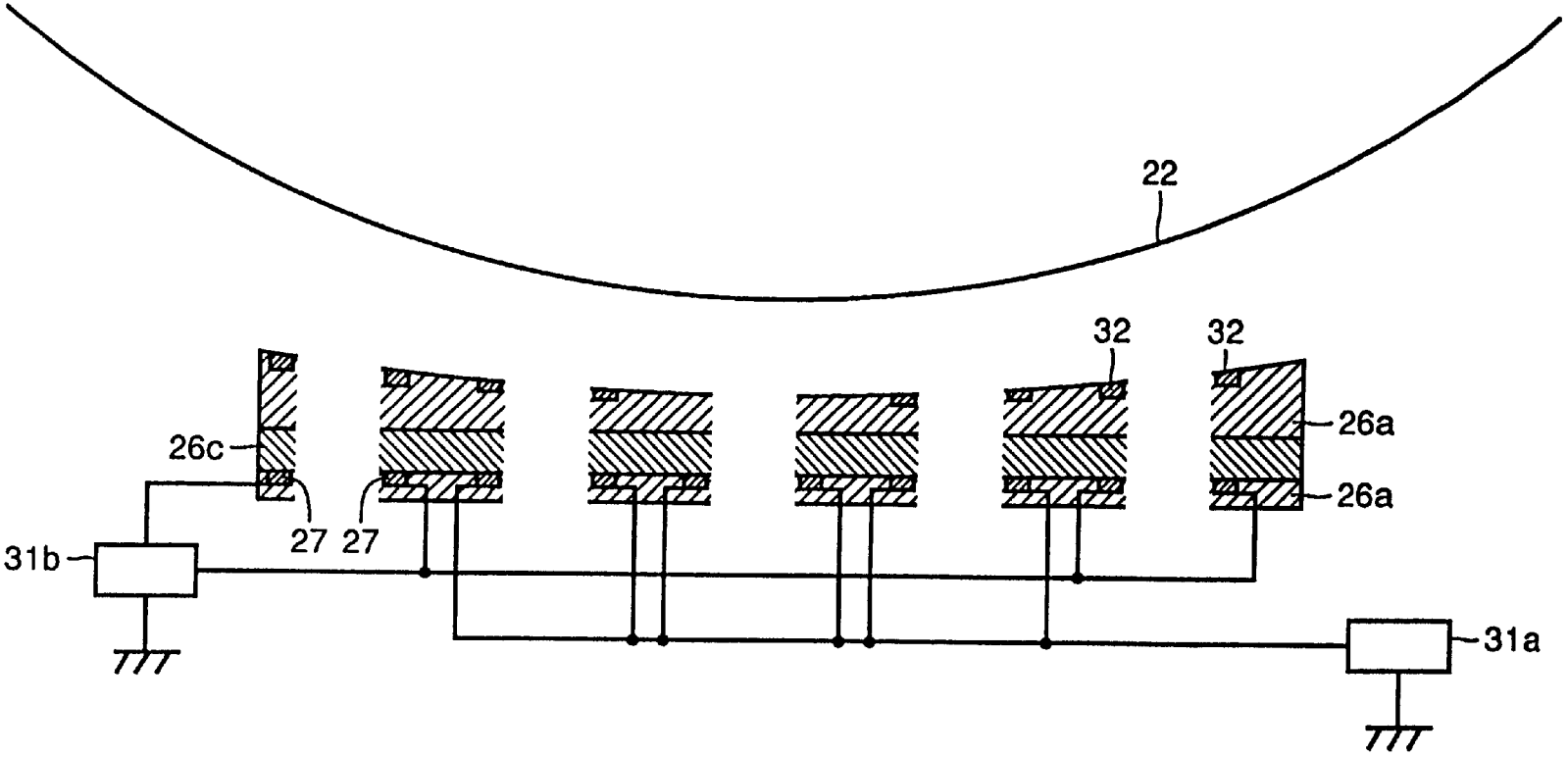
FIG. 12 is a cross section showing float electrodes in accordance with a fifth embodiment of the present invention.

In the fifth embodiment, as shown in FIG. 12, the thickness of the insulating substrate is changed in accordance with the curvature of toner carrier 22, and float electrodes 32 having the same thickness are arranged at the insulating substrate, so as to obtain the effect of float electrode 32. In the fifth embodiment, the thickness of float electrodes 32 is also changed so as to enhance the effect of the present invention, and more delicate control is made possible.

SIXTH EMBODIMENT

Figure 13:
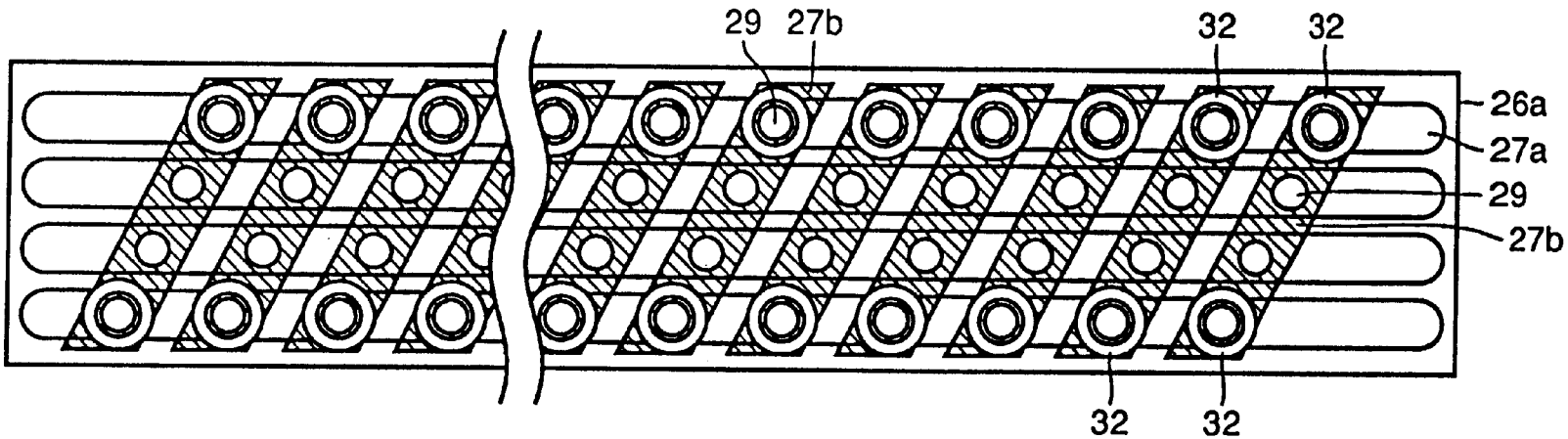
FIG. 13 is a plan view showing float electrodes for a control electrode having a matrix structure in accordance with a sixth embodiment of the present invention.

A control apparatus of single drive type in which one gate 29 is controlled by one ring-shaped electrode 27 has been described above. Control electrode 26 is not limited thereto, and a matrix drive type control electrode 26 may be used to which the present invention is applicable. FIG. 13 shows a sixth embodiment in which the present invention is applied to a matrix drive type control electrode 26. The shape of the matrix drive control electrode is not limited thereto. In the example shown in FIG. 13, strip electrodes 27*a* and 27*b* are arranged in place of ring-shaped electrodes 27. Strip electrode 27*b* is arranged on that side of control electrode 26 which faces toner carrier 22, and strip electrode 27*a* is arranged on that side which faces opposing electrode 25.

Though a black and white image forming apparatus has been described as an example, the effect is more remarkable in a color image forming apparatus. A color image forming apparatus includes a plurality of image forming units 1 each having a toner supply unit 2 and a printing unit 3. Color toners, for example, yellow, magenta, cyan and black as shown in FIG. 3, are used in respective toner supply unit 2.

It is assumed that four types of ring-shaped electrodes 27 of FIG. 3 correspond to yellow, magenta, cyan and black, respectively. Color image formation is performed based on the image data of respective colors. Other components may be the same as those shown in FIG. 2. When the present invention is applied to the color image forming apparatus employing such control electrode 26 as shown in FIG. 3, the above described problems can be solved, and therefore, desired color reproduction and satisfactory color image formation are ensured.

The control in accordance with the present invention may be implemented in each image forming unit 1 of FIG. 3. In that case, more delicate control is possibly in accordance with the characteristic of each color toner, and therefore a color image forming apparatus with superior performance can be realized.

In the above described embodiments, toner 21 has been described as an example of the developer. However, the developer may be an ink or the like. Further, ion flow method may be applied to the structure of toner supply unit 2. In other words, the image forming unit 1 may have an ion source such as a corona charger. Even in that case, similar function and effects as described above can be obtained.

The image forming apparatus in accordance with the embodiments of the present invention can be applied suitably to a printing unit of a digital copying machine and a facsimile, as well as to a digital printer, plotter or the like.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus, comprising:

carrier means for carrying a developer;

an opposing electrode arranged opposing to said carrier means;

power supply means for supplying a voltage to generate a potential difference between said carrier means and said opposing electrode;

a control electrode arranged between said carrier means and said opposing electrode;

wherein said control electrode includes:

an insulating substrate having a plurality of passage portions through which the developer passes, a plurality of developer control electrodes provided on said insulating substrate, each having a passage therethrough common to one of said plurality of passage portions in said insulating substrate, and a plurality of float electrodes arranged between said carrier means and said opposing electrode, each floating electrode having an opening provided such that at least part of each of said plurality of developer control electrodes is exposed to said carrier means; and control means for implementing a plurality of potential states at respective ones of said plurality of developer control electrodes, thereby controlling passage of said developer through the passage portions of said substrate, so as to form an image on a surface of a recording medium conveyed between said control electrode and said opposing electrode.

2. The image forming apparatus according to claim 1, wherein area of arrangement of said plurality of float electrodes is determined based on a distance between a reference surface opposing to said carrier means and said carrier means.

3. The image forming apparatus according to claim 1, wherein said plurality of float electrodes are arranged such that respective surfaces of said plurality of float electrodes facing said carrier means are placed at positions determined by a distance between a reference surface opposing to said carrier means and said carrier means.

4. The image forming apparatus according to claim 3, wherein:

said plurality of float electrodes are arranged on that side of said insulating substrate which faces said carrier means, said plurality of developer control electrodes are arranged on that side of said insulating substrate which faces said opposing electrode means, and said plurality of float electrodes are arranged along a curvature of said carrying means and such that respective surfaces of said plurality of float electrodes facing said carrier means are placed at positions determined by the distance between that surface of said insulating substrate which faces said opposing electrode and said carrier means.

5. The image forming apparatus according to claim 4, wherein that surface of said insulating substrate on which said plurality of float electrodes are arranged is flat.

6. The image forming apparatus according to claim 1, wherein:

said insulating substrate includes multiple layers of insulating substrates, said plurality of developer control electrodes are arranged on that one of the multiple layers of insulating substrates which is closest to said opposing electrode, and said plurality of float electrodes are arranged on that layer of the insulating substrate which is determined dependent upon the distance between a surface of a prescribed one of said multiple layers of insulating substrates which faces said opposing electrode and said carrier means.

7. The image forming apparatus according to claim 1, wherein thickness of said plurality of float electrodes is determined in accordance with a distance between said opening and said carrier means.

8. The image forming apparatus according to claim 7, wherein the thickness of each of said plurality of float electrodes is determined in accordance with the distance between said opening and said carrier means for each of said plurality of float electrodes.

9. The image forming apparatus according to claim 8, wherein the thickness determined for at least one float electrode of said plurality of float electrodes varies transverse to a surface of said at least one float electrode in accordance with the distance between said opening and said carrier means.

10. The image forming apparatus according to claim 1, wherein positions of said plurality of float electrodes are determined such that said electric field formed between said carrier means and said opposing electrode is made uniform.

11. The image forming apparatus according to claim 10, wherein the position of each of said plurality of float electrodes is determined such that said electric field formed between said carrier means and said opposing electrode is made uniform.

12. The image forming apparatus according to claim 1, wherein thickness of said insulating substrate is determined such that said electric field formed between said carrier means and said opposing electrode is made uniform.

13. The image forming apparatus according to claim 1, wherein positions and thicknesses of said plurality of float electrodes are determined such that said electric field formed between said carrier means and said opposing electrode is made uniform.

14. The image forming apparatus according to claim 13, wherein the position and thickness of each of said plurality of float electrodes is determined such that said electric field formed between said carrier means and said opposing electrode is made uniform.

15. The image forming apparatus according to claim 1, wherein thickness of said insulating substrate and thicknesses of said plurality of float electrodes are determined such that said electric field formed between said carrier means and said opposing electrode is made uniform.

16. The image forming apparatus according to claim 15, wherein the thickness of said insulating substrate and the thickness of each of said plurality of float electrodes is determined such that said electric field formed between said carrier means and said opposing electrode is made uniform.

17. The image forming apparatus according to claim 16, wherein the thickness determined for at least one float electrode of said plurality of float electrodes varies transverse to a surface of said at least one float electrode such that said electric field formed between said carrier means and said opposing electrode is made uniform.

18. The image forming apparatus according to claim 1, wherein respective shapes of said plurality of float electrodes are polygonal.

* * * * *